US007917059B2

(12) United States Patent
Koyama

(10) Patent No.: US 7,917,059 B2
(45) Date of Patent: Mar. 29, 2011

(54) DEVELOPING DEVICE AND IMAGE FORMING APPARATUS

(75) Inventor: Tetsu Koyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 396 days.

(21) Appl. No.: 12/068,473

(22) Filed: Feb. 7, 2008

(65) Prior Publication Data

US 2008/0205932 A1 Aug. 28, 2008

(30) Foreign Application Priority Data

Feb. 22, 2007 (JP) ..... 2007-041597

(51) Int. Cl.
*G03G 15/00* (2006.01)
*G03G 15/06* (2006.01)

(52) U.S. Cl. ..... 399/117; 399/119

(58) Field of Classification Search ..... 399/117, 399/119

See application file for complete search history.

(56) References Cited

U.S. PATENT DOCUMENTS

| | | | | |
|---|---|---|---|---|
| 3,628,504 | A * | 12/1971 | Richmond | 399/126 |
| 5,151,734 | A * | 9/1992 | Tsuda et al. | 399/111 |
| 6,731,893 | B2 * | 5/2004 | Okoshi | 399/119 |
| 6,816,692 | B1 * | 11/2004 | Kerley et al. | 399/222 |
| 6,823,156 | B2 * | 11/2004 | Okamoto | 399/119 |
| 7,327,970 | B2 * | 2/2008 | Moon | 399/111 |
| 7,627,267 | B2 * | 12/2009 | Saiki | 399/113 |

FOREIGN PATENT DOCUMENTS

| | | | |
|---|---|---|---|
| JP | 2006126750 | A * | 5/2006 |
| JP | 2006-220875 | | 8/2006 |

* cited by examiner

*Primary Examiner* — David M Gray
*Assistant Examiner* — Fred Braun
(74) *Attorney, Agent, or Firm* — Kubotera & Associates, LLC

(57) ABSTRACT

A developing device is detachably attached to an image forming apparatus. The developing device includes a first frame member; a second frame member disposed to face the first frame member; a shaft member for connecting the first frame member and the second frame member; a first engagement member disposed at one end portion of the shaft member for engaging the first frame member; a second engagement member disposed at the other end portion of the shaft member for engaging the second frame member; and a fixing member for fixing at least one of the first engagement member and the second engagement member.

11 Claims, 7 Drawing Sheets

DEVELOPING DEVICE AND IMAGE FORMING APPARATUS

BACKGROUND OF THE INVENTION

The present invention relates to a developing device and an image forming apparatus. In particular, the present invention relates to a developing device for developing toner to a latent static image to form an image and an image forming apparatus used for a copier, a printer, a facsimile, a multi-function printer (MFP), and the likes.

A conventional image forming apparatus of an electrophotography type such as a printer, a copier, a facsimile, and a multi-functional printer (MFP) is provided with a developing device of a process cartridge type detachably attached to an apparatus main body, thereby improving a maintenance operation. The developing device is integrally formed of a photosensitive drum, a charge roller for charging the photosensitive drum, a developing roller, and a cleaning device.

In recent years, high print quality has been required. Consequently, it is necessary to print an image with high definition and high quality without color shift. To this end, it is necessary to provide each component of an image forming apparatus with high dimension accuracy, high assembly accuracy, and high installation accuracy as well as constant stability.

In general, the developing device includes the developing roller for developing toner on the photosensitive drum. The developing roller is situated at a position contacting with or away from the photosensitive drum by a small distance for attaching toner to a static latent image on the photosensitive drum. A drive device rotates the developing roller. The photosensitive drum and the developing roller are supported on a side plate, i.e., a part of a frame of the developing device. (Refer to Patent Reference)

Patent Reference: Japan Patent Publication No. 2006-220875

In the conventional image forming apparatus described above, the frame of the developing device supports both end portions of shafts of the photosensitive drum and the developing roller, and the frame is formed of a plate member. Accordingly, it is difficult to obtain sufficient rigidity against a twisting force applied to the developing device. As a result, when the developing device is assembled, or each roller rotates during a printing operation and causes frictional resistance at a contacting point with respect to an adjacent roller, the developing device may twist and each roller may contact with each other. In this case, a rotational load of the developing device changes, and there is a difference in image quality between left side and right side, thereby increasing the rotational load of the developing device and lowering print quality.

In view of the problem described above, an object of the invention is to provide a developing device and an image forming apparatus, in which it is possible to solve the problems of the conventional image forming apparatus. In the developing device and the image forming device, it is possible to minimize a change in a rotational load and prevent image quality from lowering.

Further objects of the invention will be apparent from the following description of the invention.

SUMMARY OF THE INVENTION

In order to attain the objects described above, according to the present invention, a developing device is detachably attached to an image forming apparatus. The developing device includes a first frame member; a second frame member disposed to face the first frame member; a shaft member for connecting the first frame member and the second frame member; a first engagement member disposed at one end portion of the shaft member for engaging the first frame member; a second engagement member disposed at the other end portion of the shaft member for engaging the second frame member; and a fixing member for fixing at least one of the first engagement member and the second engagement member.

In the present invention, it is possible to correct and prevent a twisted state of the developing device. Accordingly, it is possible to minimize a change in a rotational load and prevent image quality from lowering.

DETAILED DESCRIPTION OF THE PREFERRED EMBODIMENTS

Hereunder, embodiments of the present invention will be described in more detail with reference to the accompanying drawings.

First Embodiment

Figure 2:
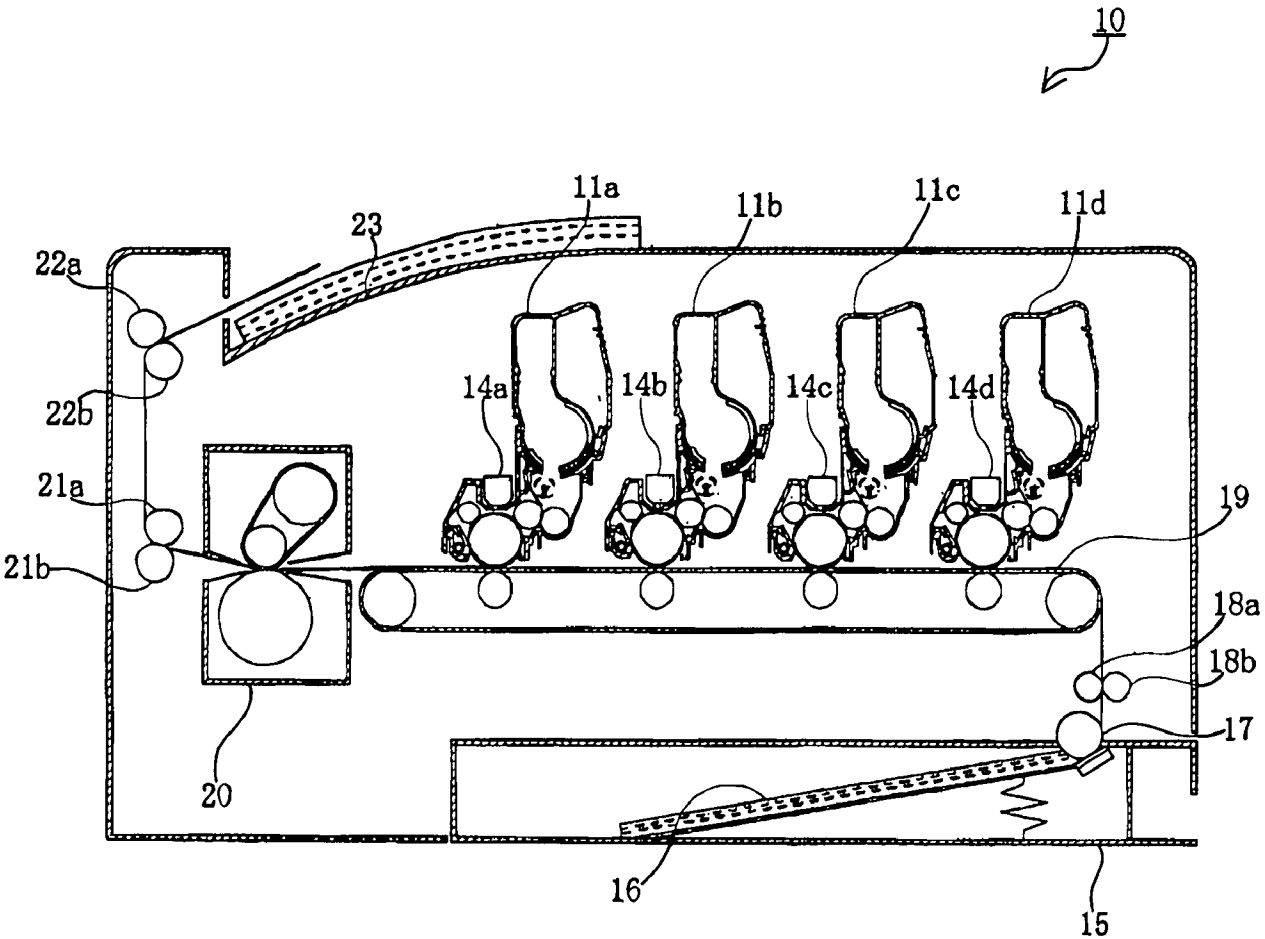
FIG. 2 is a schematic view showing an image forming apparatus according to the first embodiment of the present invention.
Figure 3:
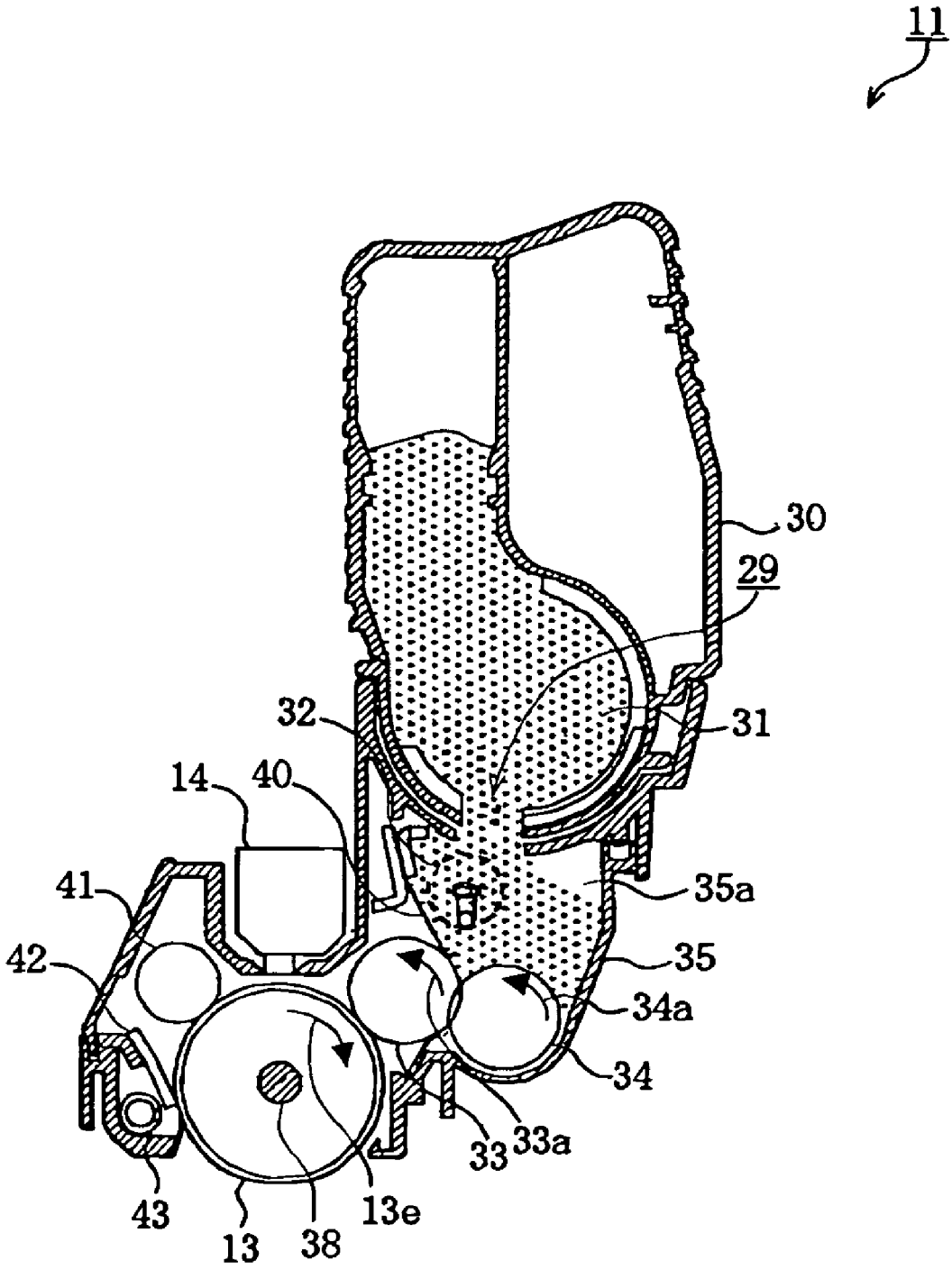
FIG. 3 is a sectional view showing the developing device according to the first embodiment of the present invention.

A first embodiment of the present invention will be explained. FIG. 2 is a schematic view showing an image forming apparatus 10 according to the first embodiment of the present invention. FIG. 3 is a sectional view showing a developing device 11 according to the first embodiment of the present invention.

In the embodiment, the image forming apparatus 10 may include any type of image forming apparatus such as a printer of an electro-photography type, a facsimile, a copier, a multi-function printer having functions of a printer, a facsimile, and a copier. The image forming apparatus 10 is a tandem type color printer of an electro-photography type.

As shown in FIG. 2, in the image forming apparatus 10, developing devices 11*a*, 11*b*, 11*c*, and 11*d* corresponding to four colors, i.e., cyan (C), magenta (M), yellow (Y), and black (K), respectively, are arranged sequentially along a transportation path of a medium 16. The developing devices 11*a*, 11*b*, 11*c*, and 11*d* have an identical configuration and retain toner in different colors.

In the embodiment, the developing devices 11*a*, 11*b*, 11*c*, and 11*d* have exposure heads 14*a*, 14*b*, 14*c*, and 14*d* corresponding to the four colors, respectively. In the following description, the developing devices 11*a*, 11*b*, 11*c*, and 11*d* and the exposure heads 14*a*, 14*b*, 14*c*, and 14*d* may be collectively referred to as the developing device 11 and an exposure head 14.

In the embodiment, the image forming apparatus 10 further includes a medium tray 15 for storing the medium 16 as a recording sheet; a sheet supply roller 17 for separating and supplying the medium 16 one by one from the medium tray 15; transportation rollers 18*a* and 18*b* for transporting the medium 16; and a transfer belt 19 for transporting the medium 16 and transferring a toner image to the medium 16. When the transportation rollers 18*a* and 18*b* transport the medium 16 to the transfer belt 19, static charge is applied to the medium 16 to be attached to the transfer belt 19. Afterward, while the developing device 11 forms the toner image, the transfer belt 19 transports the medium 16.

In the embodiment, the image forming apparatus 10 includes a fixing unit 20 as a fixing device for fixing the toner image thus transferred to the medium 16 through heat and pressure; discharge rollers 21*a*, 21*b*, 21*c*, and 21*d* for discharging the medium 16 with the toner image thus fixed to outside the image forming apparatus 10; and a stack cover 23 for holding the medium 16 thus discharged.

As shown in FIG. 3, the developing device 11 includes a chassis 35 and a toner storage container 30 disposed at an upper portion of the chassis 35 for storing toner 31. A toner hopper 35*a* is disposed in the chassis 35, and a supply opening 29 is formed in an upper surface of the toner hopper 35*a*. The toner 31 in the toner storage container 30 is supplied to the toner hopper 35*a* through the supply opening 29, so that the toner 31 is temporarily stored in the toner hopper 35*a*.

In the embodiment, a photosensitive drum 13 as an image supporting member is rotatably attached to the chassis 35. The photosensitive drum 13 has a shaft 38 as a shaft member with both end portions attached to the chassis 35 for functioning as a central axis. Further, there are provided around the photosensitive drum 13 a charge roller 41; the exposure head 14; a developing roller 33; a toner supply roller 34; a cleaning blade 42; and a waste toner discharge member 43.

In the embodiment, the charge roller 41 functions as a charge device for uniformly and evenly charging the photosensitive drum 13 rotating in an arrow direction 13*e*. The exposure head 14 includes an LED (Light Emitting Diode) head and the likes for irradiating a surface of the photosensitive drum 13 according to an image signal, so that the surface of the photosensitive drum 13 is selectively exposed to form a static latent image thereon.

In the embodiment, the developing roller 33 rotates in an arrow direction 33*a* for attaching the toner 31 to the surface of the photosensitive drum 13 with the static latent image formed thereon, thereby forming the toner image. The toner supply roller 34 rotates in an arrow direction 34*a* for supplying the toner 31 in the toner hopper 35*a* to the developing roller 33. A stirring member 32 is disposed inside the toner hopper 35*a* for stirring the toner 31. A developing blade 40 is provided for forming a thin layer of the toner 31 on the developing roller 33.

In the embodiment, the transfer belt 19 transfers the toner image formed on the surface of the photosensitive drum 13 to the medium 16 through a static force. The cleaning blade 42 has an end portion abutting against the surface of the photosensitive drum 13 for removing the toner 31 remaining on the surface of the photosensitive drum 13. The waste toner discharge member 43 discharges the toner 31 as waste toner removed from the surface of the photosensitive drum 13 with the cleaning blade 42 outside the developing device 11.

Figure 1:
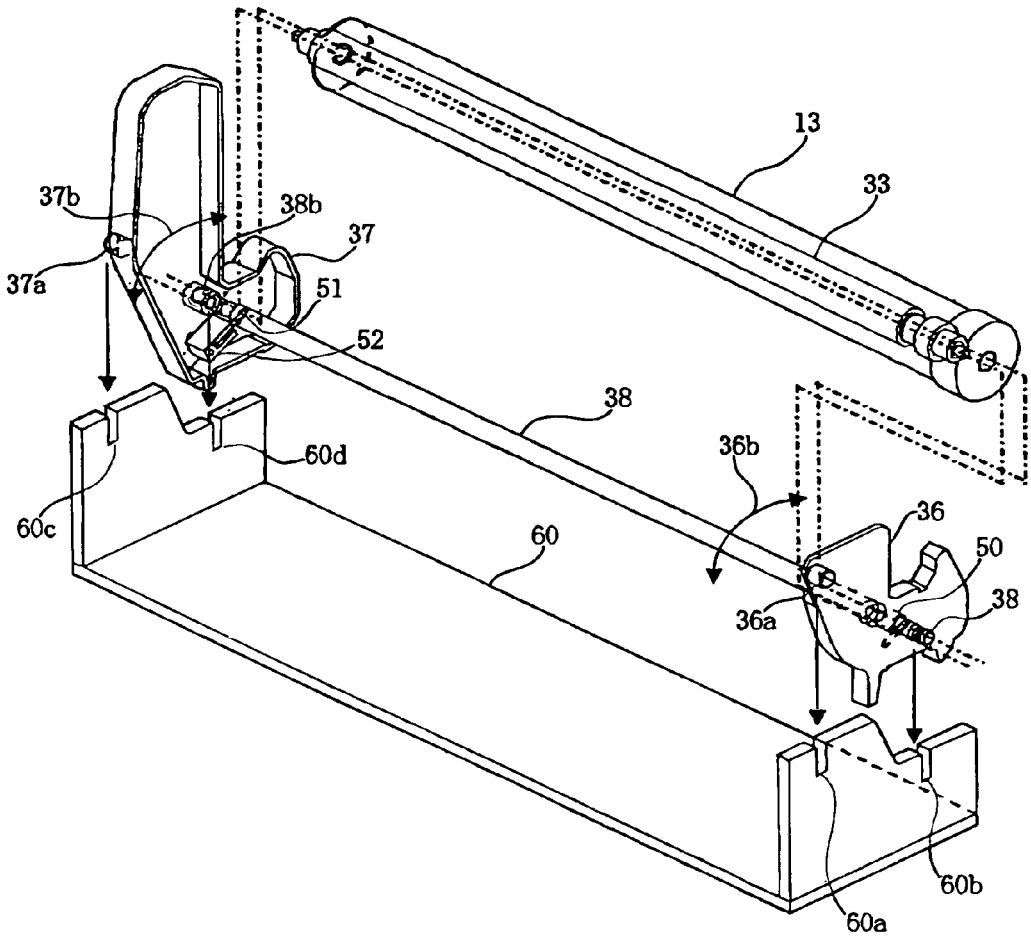
FIG. 1 is an exploded view showing a chassis of a developing device according to a first embodiment of the present invention.
Figure 4:
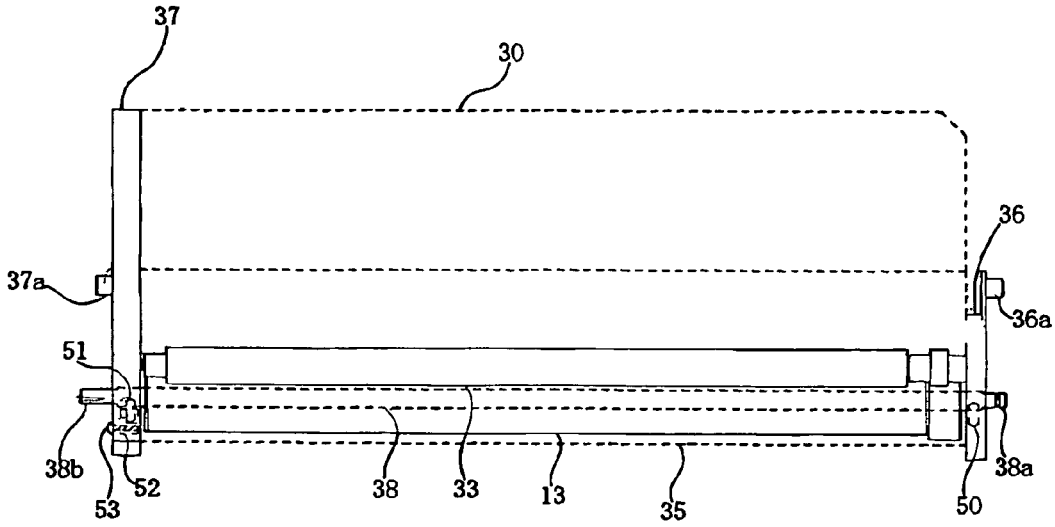
FIG. 4 is a backside view showing the chassis of the developing device according to the first embodiment of the present invention.
Figure 5:
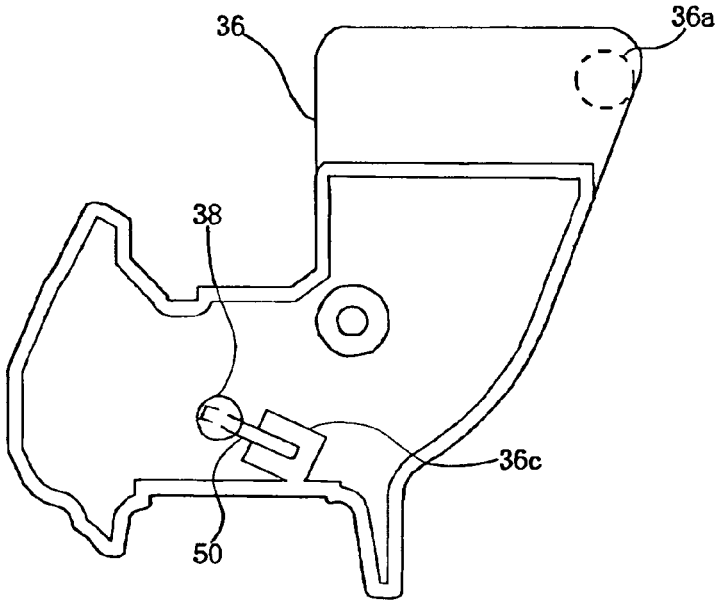
FIG. 5 is a schematic view showing a first end chassis member of the developing device according to the first embodiment of the present invention.
Figure 6:
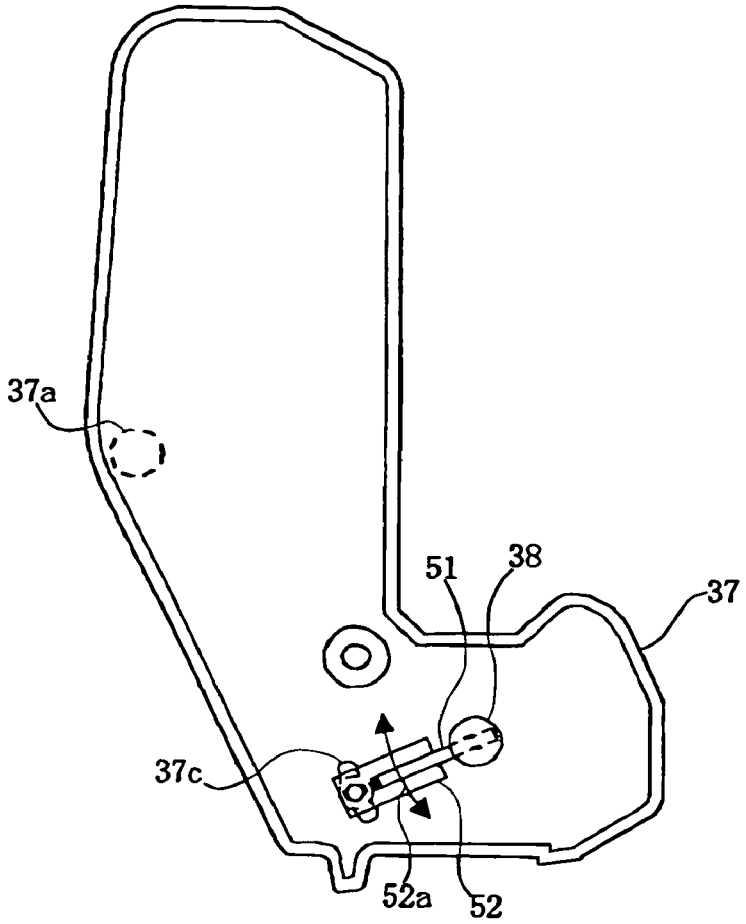
FIG. 6 is a schematic view showing a second end chassis member of the developing device according to the first embodiment of the present invention.
Figure 7:
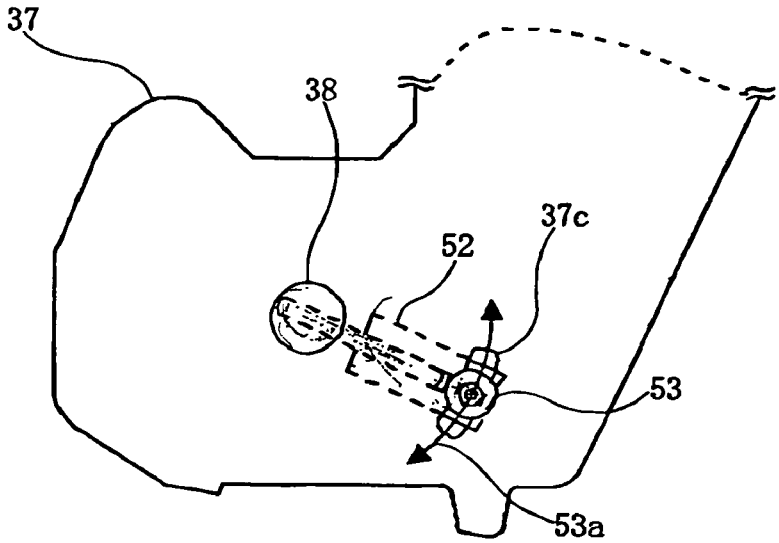
FIG. 7 is a schematic enlarged view showing the second end chassis member of the developing device according to the first embodiment of the present invention.

A configuration of the chassis 35 of the developing device 11 will be explained next. FIG. 1 is an exploded view showing the chassis 35 of the developing device 11 according to the first embodiment of the present invention. FIG. 4 is a backside view showing the chassis 35 of the developing device 11 according to the first embodiment of the present invention. FIG. 5 is a schematic view showing a first end chassis member 37 of the developing device according 11 to the first embodiment of the present invention. FIG. 6 is a schematic view showing a second end chassis member 36 of the developing device 11 according to the first embodiment of the present invention. FIG. 7 is a schematic enlarged view showing the second end chassis member 36 of the developing device 11 according to the first embodiment of the present invention.

As shown in FIG. 4, the first end chassis member 37 as a first frame member is attached to the chassis 35 with a connection member such as a screw (not shown) for covering one end portion of the chassis 35. Further, the second end chassis member 36 as a second frame member is attached to the chassis 35 with a connection member such as a screw (not shown) for covering the other end portion of the chassis 35.

In the embodiment, end portions of the shaft 38 are supported on the first end chassis member 37 and the second end chassis member 36, so that the shaft 38 does not rotate. Note that the photosensitive drum 13 is attached to the shaft 38 to be rotatable around the shaft 38. The shaft 38 has a first protruding portion 38*b* and a second protruding portion 38*a* protruding outside the first end chassis member 37 and the shaft 38, respectively. The first end chassis member 37 and the second end chassis member 36 have a first fixing protrusion 37*a* and a second fixing protrusion 36*a* protruding outside from outer side surfaces thereof, respectively. The first fixing protrusion 37*a* and the second fixing protrusion 36*a* function as fixing protrusions for fixing the first end chassis member 37 and the second end chassis member 36 inside the image forming apparatus 10.

As shown in FIG. 1, an assembly standard jig 60 is provided for assembling the developing device 11. The assembly standard jig 60 has insertion grooves 60*a*, 60*b*, 60*c*, and 60*d*. The second fixing protrusion 36*a*, the second protruding portion 38*a*, the first fixing protrusion 37*a*; and the first protruding portion 38*b* are inserted into the insertion grooves 60*a*, 60*b*, 60*c*, and 60*d*, respectively.

As shown in FIG. 5, a second engagement pin 50 as a second engagement member extends in a direction perpendicular to an axial direction of the shaft 38. One end portion of the second engagement pin 50 is inserted into the shaft 38 to be fixed, and the other end portion of the second engagement pin 50 is fixed with a second fixing rib 36*c* formed on an inner side surface of the second end chassis member 36.

As shown in FIG. 6, a first engagement pin 51 as a first engagement member extends in a direction perpendicular to the axial direction of the shaft 38. One end portion of the first engagement pin 51 is inserted into the shaft 38 to be fixed, and the other end portion of the first engagement pin 51 is fixed to a fixing member 52.

As shown in FIGS. 6 and 7, the fixing member 52 is detachably attached to the first end chassis member 37 with an attachment member 53 such as a screw. In this case, the attachment member 53 is inserted into a guide groove 37*c* with a semi-circular shape penetrating through a sidewall of the first end chassis member 37. Accordingly, when the attachment member 53 is loosen, the fixing member 52 can move along a circular path around the shaft 38. When the attachment member 53 is tightened, the fixing member 52 is fixed to the sidewall of the first end chassis member 37.

An operation of the image forming apparatus 10 will be explained next. When the image forming apparatus 10 receives a print command from a host device such as a personal computer (not shown), the image forming apparatus 10 starts an image forming operation. The sheet supply roller 17 separates and supplies the medium 16 stored in the medium tray 15 one by one, and the transportation rollers 18*a* and 18*b* transport the medium 16 to the transfer belt 19. Then, the developing device 11 corresponding to each color forms the static latent image on the surface of the photosensitive drum 13. The static latent image is developed to form the toner image, and the toner image is transferred to the medium 16 transported with the transfer belt 19.

In this case, the toner supply roller 34 of the developing device 11 is driven to rotate in the arrow direction 34*a* with a drive source (not shown), so that the toner 31 is supplied to the developing roller 33. The developing roller 33 is driven to rotate in the arrow direction 33*a* with a drive source (not shown). The developing blade 41 forms and charges a thin layer of the toner 31 on the developing roller 33.

In the embodiment, the photosensitive drum 13 is driven to rotate in the arrow direction 13*e* with a drive source (not shown), and the charge roller 41 uniformly charges the surface of the photosensitive drum 13. Then, the exposure head 14 selectively exposes the surface of the photosensitive drum 13, thereby forming the static latent image. A portion thus exposed has a potential of 0 V. The toner 31 on the developing roller 33 is supplied to the static latent image, thereby forming the toner image.

Afterward, the toner image formed on the surface of the photosensitive drum 13 is transferred to the medium 16 transported with the transfer belt 19 through a static force. The cleaning blade 42 scrapes off and removes the toner 31 remaining on the surface of the photosensitive drum 13 and not transferred to the medium 16. The waste toner discharge member 43 discharges the toner 31 thus removed outside the developing device 11 as waste toner.

After the toner image is transferred, the medium 16 is transported to the fixing unit 20, so that the toner image transferred to the medium 16 is fixed to the medium 16 through heat and pressure. After the fixing unit 20 fixes the toner image to the medium 16, the discharge rollers 21*a*, 21*b*, 21*c*, and 21*d* discharge the medium 16 outside the image forming apparatus 10, so that the medium 16 is placed on the stacker cover 23.

When the developing device 11 is assembled, after the rollers such as the developing roller 33 and the toner supply roller 34 are attached inside the chassis 35, the first end chassis member 37 and the second end chassis member 36 are attached. Accordingly, depending on part dimension accuracy or assembly accuracy of the first end chassis member 37 or the second end chassis member 36, the first end chassis member 37 and the second end chassis member 36 may be shifted in arrow directions 37*b* and 36*b* shown in FIG. 1 around the shaft 38, so that the first end chassis member 37 and the second end chassis member 36 are positioned in a twisted relationship.

In the embodiment, to this end, the assembly standard jig 60 is used, so that the second fixing protrusion 36*a*, the second protruding portion 38*a*, the first fixing protrusion 37*a*; and the first protruding portion 38*b* are inserted into the insertion grooves 60*a*, 60*b*, 60*c*, and 60*d*, respectively. As a result, the first end chassis member 37 and the second end chassis member 36 are positioned in a corrected relationship.

In this case, as shown in FIG. 7, when the attachment member 53 is loosen and moves along the guide groove 37*c*, the fixing member 52 moves together with the attachment member 53 and rotates in an arrow direction 52*a* shown in FIG. 6 around the shaft 38. Accordingly, the first end chassis member 37 rotates around the shaft 38, thereby correcting the twisted relationship of the first end chassis member 37 and the second end chassis member 36.

Once the twisted relationship of the first end chassis member 37 and the second end chassis member 36 is corrected, the attachment member 53 is tightened and fixed to the sidewall of the first end chassis member 37. Note that it is possible to operate the attachment member 53 from outside the first end chassis member 37. Accordingly, it is possible to easily correct or adjust the twisted relationship of the first end chassis member 37 and the second end chassis member 36.

As described above, in the embodiment, the one end portions of the first engagement pin 51 and the second engagement pin 50 are attached to the shaft 38. The other end portions of the first engagement pin 51 and the second engagement pin 50 engage the first end chassis member 37 and the second end chassis member 36. Further, the fixing member 52 is provided for fixing the other end portion of the first engagement pin 51 to the first end chassis member 37. Accordingly, it is possible to increase rigidity of the developing device 11 against a twisting force. Further, it is possible to prevent the developing device 11 from twisting during the assemble process or the printing operation, and to prevent a contact state of the rollers from changing, thereby preventing print quality from lowering.

Further, in the embodiment, the fixing member 52 is able to move with respect to the first end chassis member 37. Accordingly, after the developing device 11 is assembled, it is possible to correct the twisted state of the developing device 11. Further, the fixing member 52 is attached to the first end chassis member 37 with the attachment member 53 that is detachable. Accordingly, it is possible to easily disassemble the developing device 11, thereby maintaining good recycle ability.

Second Embodiment

A second embodiment of the present invention will be described below. In the description below, elements in the second embodiment similar to those in the first embodiment are designated by same reference numerals, and explanations thereof are omitted. Explanations of operations and effects in the second embodiment similar to those in the first embodiment are omitted.

Figure 8:
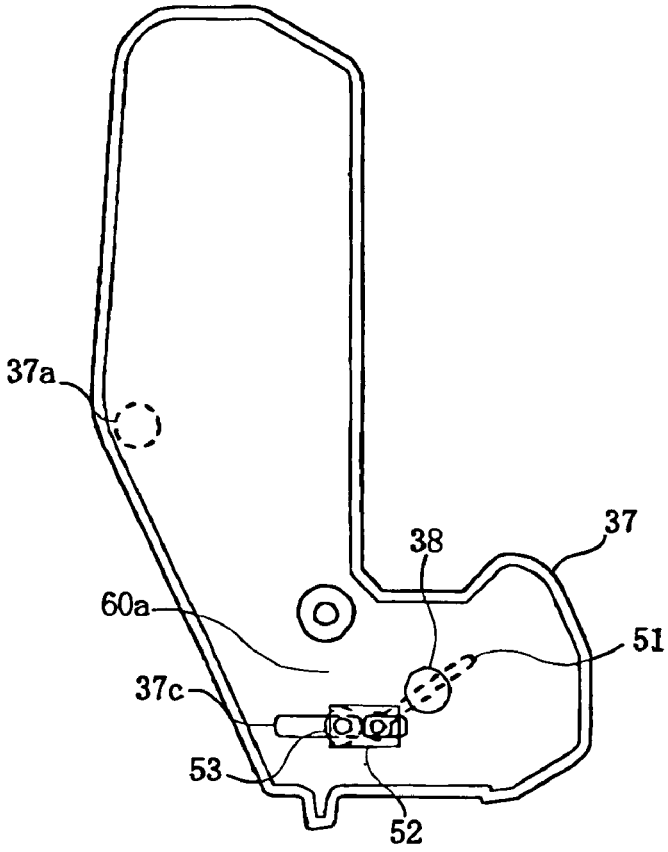
FIG. 8 is a schematic view showing a first end chassis member of a developing device according to a second embodiment of the present invention.
Figure 9:
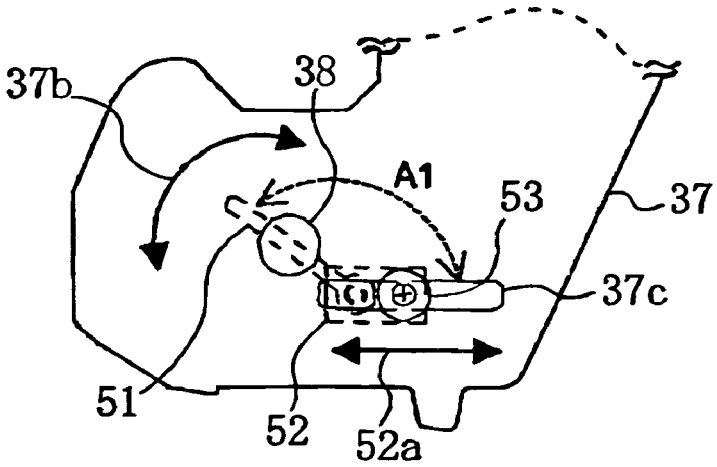
FIG. 9 is a schematic enlarged view No. 1 showing the first end chassis member of the developing device according to the second embodiment of the present invention.
Figure 10:
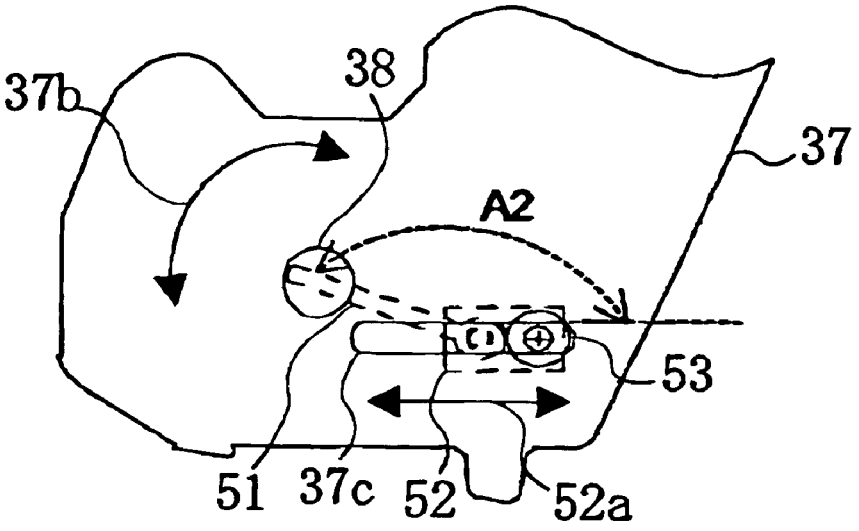
FIG. 10 is a schematic enlarged view No. 2 showing the first end chassis member of the developing device according to the second embodiment of the present invention.
Figure 11:
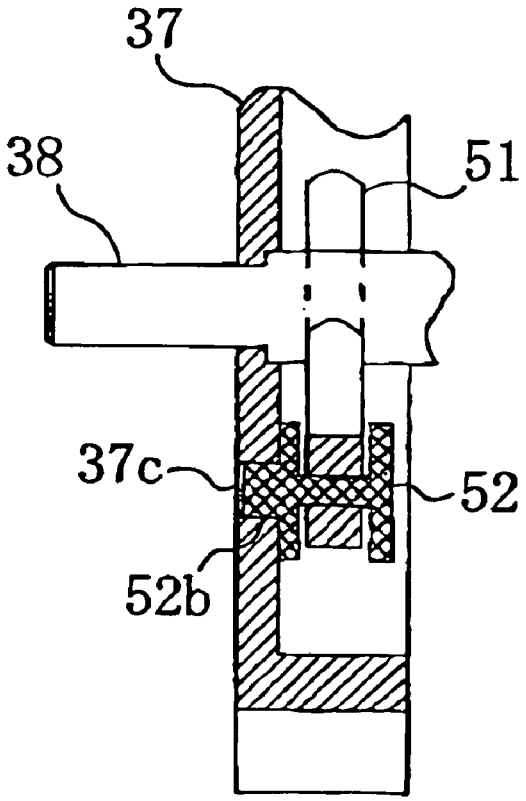
FIG. 11 is a schematic sectional view showing the first end chassis member of the developing device according to the second embodiment of the present invention.

FIG. 8 is a schematic view showing the first end chassis member 37 of the developing device 11 according to the second embodiment of the present invention. FIG. 9 is a schematic enlarged view No. 1 showing the first end chassis member 37 of the developing device 11 according to the second embodiment of the present invention. FIG. 10 is a schematic enlarged view No. 2 showing the first end chassis member 37 of the developing device 11 according to the second embodiment of the present invention. FIG. 11 is a schematic sectional view showing the first end chassis member 37 of the developing device 11 according to the second embodiment of the present invention.

In the second embodiment, the fixing member 52, the guide groove 37*c*, and the first engagement pin 51 have configurations different from those in the first embodiment.

As shown in FIG. 8, the first engagement pin 51 passes through an insertion hole penetrating through the shaft 38 in a radial direction thereof, so that the first engagement pin 51 moves in the radial direction.

In the embodiment, the fixing member 52 engages the one end portion of the first engagement pin 51. Further, the first engagement pin 51 is rotatable with respect to the fixing member 52 around an engagement portion thereof with the fixing member 52.

In the embodiment, the guide groove 37*a* penetrates through the sidewall of the first end chassis member 37, and have a linear shape. The attachment member 53 is inserted into the guide groove 37*c* for attaching the fixing member 52 to the first end chassis member 37. Accordingly, the fixing member 52 and the attachment member 53 move linearly along the guide groove 37*c*. Similar to the first embodiment, the attachment member 53 may be a screw or a detachable member. Accordingly, when the attachment member 53 is tightened, the fixing member 52 is fixed to the sidewall of the first end chassis member 37.

In the embodiment, the fixing member 52 is provided with a protruding portion 52*b* to be inserted into the guide groove 37*c*. The protruding portion 52*b* is arranged to fit in the guide groove 37*c* without a play. Accordingly, the fixing member 52 stably moves along the guide groove 37*c* without wobble. Further, it is possible to firmly fix the fixing member 52 to the first end chassis member 37 when the fixing member 52 is tightened. Other configurations are similar to those in the first embodiment, and explanations thereof are omitted.

An operation of the image forming apparatus 10 will be explained next. In the following description, only an operation of assembling the developing device 11 will be explained.

Similar to the first embodiment, upon assembling the developing device 11, when the first end chassis member 37 and the second end chassis member 36 are positioned in the twisted relationship with the shaft 38 at the center thereof, the assembly standard jig 60 is used to correct the twisted relationship of the first end chassis member 37 and the second end chassis member 36.

In this case, as shown in FIGS. 9 and 10, when the attachment member 53 is loosen and moves along the guide groove 37*c* in the arrow direction 52*a*, the fixing member 52 moves together with the attachment member 53 linearly in the arrow direction 52*a*. At this moment, the one end portion of the first engagement pin 51 rotatably engages the fixing member 52. Accordingly, the first engagement pin 51 rotates around the shaft 38 in the arrow direction 37*b* shown in FIGS. 9 and 10. As a result, the first end chassis member 37 rotates around the shaft 38, thereby correcting the twisted relationship of the first end chassis member 37 and the second end chassis member 36.

Once the twisted relationship of the first end chassis member 37 and the second end chassis member 36 is corrected, the attachment member 53 is tightened and fixed to the sidewall of the first end chassis member 37. Note that it is possible to operate the attachment member 53 from outside the first end chassis member 37. Accordingly, it is possible to easily correct or adjust the twisted relationship of the first end chassis member 37 and the second end chassis member 36.

As shown in FIG. 9, the fixing member 52 is situated at a position closest to the shaft 38. In this state, the first engagement pin 51 forms an angle A1 with respect to the guide groove 37*c* having a linear shape. As shown in FIG. 10, the fixing member 52 is situated at a position furthest to the shaft 38. In this state, the first engagement pin 51 forms an angle A2 with respect to the guide groove 37*c* having a linear shape. A relationship between the angle A1 and the angle A2 is given by the following equation.

$$A1<A2$$

In the embodiment, when the first end chassis member 37 and the second end chassis member 36 are twisted at a maximum angle AS, the angle A1 and the angle A2 have the following relationship with respect to the angle AS.

$$AS \leqq A2-A1$$

Other operations in the second embodiment are similar to those in the first embodiment, and explanations thereof are omitted.

As described above, in the second embodiment, the protruding portion 52*b*, i.e., a part of the fixing member 52, is inserted into the guide groove 37*c*. Accordingly, in addition to the effect in the first embodiment, it is possible to increase an contact area between the fixing member 52 and the first end chassis member 37, thereby further increasing rigidity against a twisting force.

In the first and second embodiments, the present invention is applied to the developing device 11, and may be applicable to an apparatus such as a cleaning device, a toner cartridge, a medium transportation device, a transfer device, and a fixing device, in which toner is used. Further, the present invention is applicable to the image forming apparatus 10 used for a copier, an LED printer, a laser beam printer, a facsimile, an MFP, and the likes.

The disclosure of Japanese Patent Application No. 2007-041597, filed on Feb. 22, 2007, is incorporated in the application.

While the invention has been explained with reference to the specific embodiments of the invention, the explanation is illustrative and the invention is limited only by the appended claims.

What is claimed is:

1. A developing device detachably attached to an image forming apparatus, comprising:

a first frame member;

a second frame member disposed to face the first frame member;

a shaft member for connecting the first frame member and the second frame member;

a first engagement member disposed at one end portion of the shaft member for engaging the first frame member;

a second engagement member disposed at the other end portion of the shaft member for engaging the second frame member; and a fixing member for fixing at least one of the first engagement member and the second engagement member, wherein said first frame member includes a groove portion for supporting the fixing member to be slidable, and said fixing ember is adapted so that the first frame member rotates around the shaft member to adjust a relative positional relationship between the first frame member and the second frame member when the fixing member is loosen to disconnect the first engagement member from the first frame member.

2. The developing device according to claim 1, wherein said groove portion has a circular shape around the shaft member.

3. The developing device according to claim 2, wherein said fixing member is adapted to be movable together with the first engagement member along the groove portion in a circular path with respect to the first frame member when the fixing member is loosen to disconnect the first engagement member from the first frame member.

4. The developing device according to claim 2, wherein said first engagement member is connected to the shaft member.

5. The developing device according to claim 2, wherein said first engagement member is supported on the shaft member to be slidable.

6. The developing device according to claim 1, wherein said groove portion has a linear shape.

7. The developing device according to claim 6, wherein said fixing member supports the first engagement member to be slidable.

8. The developing device according to claim 6, wherein said fixing member is adapted to be movable along the groove portion in a linear path with respect to the first frame member when the fixing member is loosen to disconnect the first engagement member from the first frame member.

9. The developing device according to claim 1, wherein said shaft member is an axis of an image supporting member.

10. The developing device according to claim 1, wherein said fixing member is adapted to be movable when the developing device is attached to a standard jig.

11. An image forming apparatus comprising the developing device according to claim 1.

* * * * *